United States Patent [19]

Freeman, Jr.

[11] 4,453,108

[45] Jun. 5, 1984

[54] DEVICE FOR GENERATING RF ENERGY FROM ELECTROMAGNETIC RADIATION OF ANOTHER FORM SUCH AS LIGHT

[75] Inventor: John W. Freeman, Jr., Houston, Tex.

[73] Assignee: William Marsh Rice University, Houston, Tex.

[21] Appl. No.: 329,427

[22] Filed: Dec. 10, 1981

Related U.S. Application Data

[63] Continuation-in-part of Ser. No. 208,942, Nov. 21, 1980, abandoned, which is a continuation-in-part of Ser. No. 90,889, Nov. 5, 1979, abandoned, which is a continuation-in-part of Ser. No. 38,117, May 11, 1979, abandoned.

[51] Int. Cl.[3] ..... H01J 25/02

[52] U.S. Cl. ..... 315/5.18; 315/4; 315/5; 331/93

[58] Field of Search ..... 315/3, 4, 5, 5.18; 331/93; 250/213 VT; 455/600, 613, 620

[56] References Cited

U.S. PATENT DOCUMENTS

| | | | |
|---|---|---|---|
| 1,962,195 | 6/1934 | Hollmann | 331/93 |
| 2,138,920 | 12/1938 | Hollmann | 331/93 |
| 2,272,605 | 2/1942 | Heising | 315/4 |
| 2,459,283 | 1/1949 | McNall | 315/32 |
| 3,154,748 | 10/1964 | Javan et al. | 250/213 VT |
| 3,231,741 | 1/1966 | Siegman | 250/213 VT |
| 3,275,869 | 9/1966 | Feist | 313/65 |
| 3,390,272 | 6/1968 | Fisher | 250/199 |
| 3,403,257 | 9/1968 | Petroff | 315/5 |
| 3,424,996 | 1/1969 | Hamilton | 331/84 |
| 4,150,340 | 4/1979 | Kapetanakos et al. | 315/5 |
| 4,313,072 | 1/1982 | Wilson et al. | 315/4 |

OTHER PUBLICATIONS

Kleen, *Electronics of Microwave Tubes*, Academic Press Inc., New York, 1958, pp. 92–93, 100–103, 154–167.

Freeman et al., "New Methods for the Conversion of Solar Energy to Radio Frequency and Laser Power", Fourth Princeton/AIAA Conference on Space Manufacturing Facilities, May 14–17, 1979.

Freeman et al, "The Photoklystron", Space Solar Power Review, vol. 1, pp. 145–154, 1980.

"Prototype Sunlight-to-RF-Energy Converter Could Advance Solar-Energy Use", EDN Nov. 20, 1980.

*Primary Examiner*—Saxfield Chatmon

*Attorney, Agent, or Firm*—Shapiro and Shapiro

[57] ABSTRACT

A device for generating RF energy from electromagnetic radiation of another form, such as light, includes an emitter responsive to the electromagnetic radiation for producing a beam of charged particles, an electrode spaced from the emitter to define a path for the charged particles, and a resonant structure for supporting RF oscillations and disposed with respect to the path to enable energy transfer between the charged particles and an RF field associated with the RF oscillations. When biased, the devices operate in a multi-pass mode, wherein the charged particles undergo multiple oscillations while remaining in phase with the RF field. When unbiased, the devices operate in a half-cycle mode to produce RF oscillations with no externally applied input power other than the electromagnetic radiation.

42 Claims, 5 Drawing Figures

DEVICE FOR GENERATING RF ENERGY FROM ELECTROMAGNETIC RADIATION OF ANOTHER FORM SUCH AS LIGHT

CROSS REFERENCE TO RELATED APPLICATIONS

This application is a continuation-in-part of application Ser. No. 208,942, filed Nov. 21, 1980, which is a continuation-in-part of application Ser. No. 90,889, filed Nov. 5, 1979, which in turn is a continuation-in-part of application Ser. No. 38,117, filed May 11, 1979, all of which are now abandoned.

BACKGROUND OF THE INVENTION

This invention relates generally to devices for generating RF energy from electromagnetic radiation of another form, and more particularly to devices for generating RF energy from light.

The prior art is replete with all sorts of RF generators, including magnetrons, TWT-type devices such as backward wave oscillators, klystrons, etc. In general, such devices employ high velocity, high energy electrons, and require, inter alia, high voltages, substantial external input power, focused beams and elongated structures. It is desirable to provide RF generators which avoid these and other disadvantages of known RF generators, and it is to this end that the present invention is directed.

SUMMARY OF THE INVENTION

Remarkably, the present invention provides rather simple, low-cost devices for generating RF energy from electromagnetic radiation of another form, such as light, which operate with low energy charged particles, without focusing or elongated structures, and which operate with little or no external applied power. As used herein, "low energy" refers to energies which are substantially less than the several hundreds of electron volts (eV) or more which are normally encountered with known RF generators such as magnetrons, klystrons, TWT-type devices, and the like. Similarly, the term "low voltage" as used herein refers to voltages substantially less than the voltages normally used with such RF generators. Although the invention is concerned principally with low energy/low voltage devices, some of the unique features of the invention may be applicable to other devices as well. In one of its forms, the invention quite surprisingly provides a device which produces RF oscillations without any externally applied power whatsoever, except for the input electromagnetic radiation. Although, in some respects, devices in accordance with the invention resemble reflex klystrons, there are significant differences which will be explained hereinafter.

Broadly stated, in one form, the invention provides a device for generating RF energy from electromagnetic radiation of another form that comprises emitter means responsive to the electromagnetic radiation for producing a beam of charged particles, an electrode spaced from the emitter means, the emitter means and the electrode defining a path along which the charged particles move, the path having a predetermined path length and the emitter means having a dimension transverse to the path that is greater than the path length such that the beam of charged particles has a transverse dimension greater than the path length, and a resonant structure for supporting RF oscillations, the resonant structure being located with respect to the path to enable energy transfer between the charged particles and an RF field associated with the RF oscillations.

The invention also provides a device wherein charged particles move along a path between an emitter means and an electrode primarily as the result of the kinetic energy imparted to the charged particles by the electromagnetic radiation, and transfer energy to an RF field associated with RF oscillations in a resonant structure.

In another aspect, the invention provides a method of generating RF energy from electromagnetic radiation of a different form and comprises producing from the electromagnetic radiation an unfocused beam of low energy charged particles that move along a predetermined path, and locating the path substantially totally within an RF field associated with RF oscillations in a resonant structure to enable energy transfer between charged particles and the RF field.

Other aspects of the invention will become apparent in the detailed description which follows.

DESCRIPTION OF THE PREFERRED EMBODIMENTS

Figure 1:
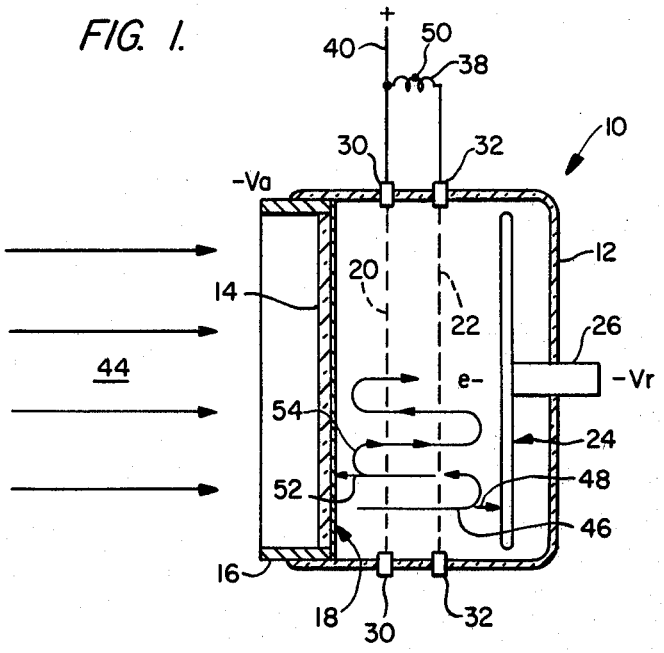
FIG. 1 is a schematic view of a device in accordance with a first embodiment of the invention, the device being illustrated in a biased configuration.

FIG. 1 is a schematic diagram of a device 10 in accordance with a first embodiment of the invention for generating RF energy directly from another form of electromagnetic radiation. For purposes of illustration, the invention will be described in connection with a device for converting light into RF energy. However, as will become apparent, the principles of the invention are also applicable to converting other forms of electromagnetic radiation to RF energy.

As shown in FIG. 1, device 10 generally comprises a pressure-tight evacuated housing 12 which may be a cylindrical glass tube shaped as illustrated and having one end closed by a planar transparent window 14, as of glass, formed in the end of a metallic terminal ring 16. A thin layer of photoemissive material 18, such as a cesium-antimony alloy, may be deposited on the inside surface of window 14 in electrical contact with terminal ring 16 to form a photocathode. First and second grids 20, 22 and a metallic reflector electrode 24 may be disposed within housing 12 in spaced parallel planar relationship to photocathode 18, as shown. Reflector electrode 24 may have a terminal 26 which extends through housing 12 to enable electrical connection to the electrode, and grids 20 and 22 may be connected to annular metallic rings 30, 32, respectively, which extend through the side walls of the housing to enable electrical connection to the grids. Grids 20 and 22 may comprise standard metal mesh grids which preferably are at least 90% transparent.

Photocathode 18, grids 20 and 22, and electrode 24 may all be circularly shaped (in a plane perpendicular to the plane of the drawing), although other shapes may also be employed. Approximate dimensions for device 10 may be as follows: Housing 12 may be 58 mm in diameter; the spacing between photocathode 18 and grid 20 may be 10 mm; the spacing between grids 20 and 22 may be 8 mm; and reflector electrode 24 may be located 10 mm from grid 22. Actual devices having these dimensions have been constructed and tested. However, as will be described hereinafter, other dimensions may also be employed.

Device 10, which may be referred to as a "Phototron", is an RF oscillator that operates to convert light energy to RF energy directly. As shown in FIG. 1, grids 20 and 22 may be electrically connected together through an inductor 38. The grids and the inductor together constitute a resonant structure having a resonant frequency determined by the value of the inductor and the interelectrode capacitance between the grids, and establish the operating frequency (approximately) of the Phototron. As will be described more fully shortly, Phototron 10 has two main operating modes, i.e., the "multipass" mode and the "half-cycle" mode, and may be operated either biased or unbiased.

FIG. 1 illustrates Phototron 10 in a biased configuration, wherein grids 20 and 22 are biased positively with respect to the potential (−Va) of photocathode 18 and the potential (−Vr) of reflector electrode 24, as with external power supplies (not illustrated) connected to one side 40 of inductor 38 and to terminal ring 16 and to reflector electrode terminal 26. In the biased configuration, the Phototron operates in the multi-pass mode, as will now be described.

When light energy 44, which may have a constant intensity, passes tthrough window 14 and strikes photocathode 18, the photocathode emits a beam of low energy electrons 46 having a width substantially equal to the width of the photocathode. The electrons are accelerated by the positive potential on the grids and pass through the grids, as shown. After passing through the grids, some electrons are repelled by the negatively biased reflector electrode 24 and move back through the grids toward the photocathode. Electrons which pass through the grids at such a phase as to be accelerated by the RF electric field gain sufficient energy to avoid being turned around at the reflector electrode. These electrons (shown at 48) collide with the reflector electrode and are lost to the beam. Other electrons 52 similarly may be lost to the beam by collision with the photocathode upon their return. On the other hand, electrons which pass through the grids at such a phase as to be decelerated by the RF electric field give up energy to the RF field and are turned around before reaching the reflector electrode and pass back through the grids. This process may be referred to as electron "selection". The negative bias on the reflector electrode is adjusted to return the electrons to the grids after one-half cycle of the RF electric field so that the electrons may again give up energy to the RF electric field on their return trip through the grids. The same electrons may be turned around again upon approaching the photocathode (as shown at 54) because of its negative bias.

In the Phototron, the photocathode, the grids and the reflector electrode define a plurality of successive regions along the electron path. By properly connecting the photocathode and the reflector electrode to the inductor that is connected to the grids, an RF field may be established in each of the regions that is in anti-phase with the RF field in a neighboring region. If the voltages on the photocathode and reflector electrode are adjusted properly, the cycle time of the electrons, i.e., the sum of the times required for two grid crossings and two turn-arounds, will be such that upon each subsequent pass through the grids, the RF field in each region will have a negative going phase and the electrons will be continuously decelerated. The electrons will remain substantially in phase with the RF field and will, therefore, undergo a periodic motion and make multiple passes through the grids (as shown in FIG. 1) continuously giving up energy to the RF field in each region, thereby reinforcing the oscillations in the resonant structure. It has been found that the electron cycle time remains approximately constant and that the electrons remain in proper phase with the RF field for a number of cycles, i.e., passes through the grids, to continue to give up energy to the field even as they decrease in energy. As the electrons lose energy, their transit times between the grids increase, but their turn-around times decrease to compensate for the increased transit times.

For multi-pass mode operation the bias voltages are adjusted such that the cycle time for periodic electron motion is a multiple of the period of the RF field, i.e., a multiple of the period of the oscillations in the resonant structure. This condition can be expressed by the following equation:

$$\frac{n}{f} = \frac{2m\delta v}{eV_a} + \frac{2d}{v} + \frac{2m\epsilon v}{eV_r} \qquad (1)$$

where:

$n$ = integer
$f$ = frequency
$v$ = velocity
$V_a$ = accelerating voltage
$V_r$ = reflecting voltage
$e$ = the fundamental charge
$m$ = electron mass
$d$ = grid separation
$\delta$ = cathode to first grid distance
$\epsilon$ = second grid to reflector distance Equation (1) was derived from computer simulation and analysis of the electric fields in the Phototron and the resulting electron trajectories, and has been experimentally verified.

From Equation (1), it can be seen that electrons will stay in phase with the RF field when (for a given set of interelectrode spacings for the Phototron) the values of the accelerating voltage (photocathode to grid voltage) and the reflecting voltage on reflector electrode 24 are adjusted such that n takes on integer or near integer values. There are a plurality of different voltage values for which the equation is satisfied, showing that the Phototron can operate at higher order mode numbers, n, wherein "mode number" refers to the number of RF oscillations for a single electron cycle. The equation also indicates that higher frequency operation is, in general, associated with higher voltages, but that higher frequency operation is also possible (at higher order modes) with low voltages.

It has been found that approximately half of the electrons that are emitted by photocathode 18 are eliminated by collision with either the photocathode or the reflector electrode, as previously described, within their first cycle. These are the electrons that are emitted with a phase such that they gain energy from the RF field, rather than give up energy to the RF field. In fact, any "parasitic" electrons will be eliminated whenever their kinetic energy becomes too great for them to be reflected. The properly phased electrons which give up kinetic energy to the RF field continue to provide energy to drive the RF oscillations in the resonant structure during their multiple passes. The Phototron does not depend upon the electron beam being "bunched". Rather, properly phased electrons are "selected", and improperly phased electrons are removed from the beam rather than being forced into the proper phase.

An important advantage of the Phototron of FIG. 1 is that it will operate at rather low voltages such as may be encountered in typical transistor cicrcuits, e.g., 24 volts or less. For example, with an inductor having a value of several microhenrys, typical bias voltages may be +12 volts for the accelerating voltage (grid to photocathode voltage) and −13 volts for the reflector electrode to photocathode bias voltage for operation at 30 MHz. Bias voltages and physical dimensions affect the operating frequency and efficiency of the Phototron. As noted above, for a Phototron having given physical dimensions, the bias voltages are selected in accordance with Equation (1) for the desired frequency of operation, which is determined principally by the resonant frequency of inductor 38 and the interelectrode capacitance between grids 20 and 22. Fine tuning of the frequency may be accomplished by adjusting the accelerating or reflector electrode voltages. At higher frequencies, reducing the inter-electrode spacings will lower the mode number, n, and increase the efficiency of the Phototron. Moreover, reducing the interelectrode spacings enables higher frequency operation at lower voltages.

The physical dimensions of the Phototron affect its efficiency in another way. The amount of energy transferred to the RF field by the electrons is a function of the number of electrons that pass through the grids, and the number of electrons emitted by the photocathode is a function of its emitting surface area. Thus, it is preferred that the photocathode have a surface area such that when the surface area and the electron path length between the photocathode and the reflector electrode are expressed in the same dimensional units (neglecting the square of the surface area units), the ratio of the surface area to the path length is at least 2:1. Although the photocathode may have different shapes, as noted earlier, it is also preferred that the minimum transverse (to the electron path) dimension of the photocathode be greater than the path length. Unlike thermionic cathodes, which have "hot spots", the photocathode emits a beam of electrons having a substantially uniform cross-sectional density. A small interelectrode spacing between the photocathode and the reflector electrode is also advantageous in minimizing beam spreading and enables the Phototron to operate without beam focusing structures. Phototron devices having the dimensions previously given have been operated at frequencies from approximately 2 to 240 MHz in the biased mode.

Figure 2:
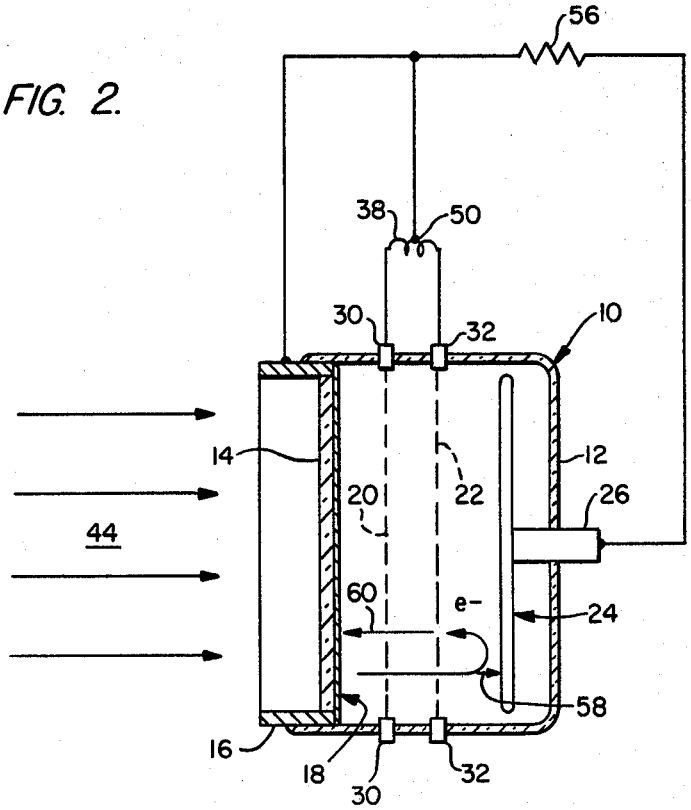
FIG. 2 is a schematic view of the device of FIG. 1 illustrating the operation of the device in an unbiased configuration.

FIG. 2 illustrates Phototron 10 in an unbiased configuration. In this configuration, the Phototron operates principally in a half-cycle mode rather than in a multipass mode. The half-cycle mode of operation is an especially important operating mode for Phototrons in accordance with the invention. Remarkably, it has been found that the Phototron will oscillate in an unbiased configuration with no externally applied power whatsoever, other than the light energy input. It has been found that when the accelerating and reflecting electrode voltages are set to zero and photocathode 18 and reflecting electrode 24 are electrically connected to the center tap 50 of inductor 38, the Phototron will self-oscillate. This enables the direct conversion of light, e.g., sunlight, to RF energy without the use of any additional energy sources.

As shown in FIG. 2, the reflector electrode 24 may be connected to center tap 50 of inductor 38 through a resistor 56. Although not necessary for self-oscillation, at some light intensities and at some frequencies, operation is improved by using resistor 56. As will be explained shortly, since electrons collide with the reflector electrode in this operating mode, a small current flow is produced through resistor 56 which provides a small negative self-bias on the reflector electrode. A value of 100K ohms for the resistor has been found to work well.

For unbiased operation, the intrinsic kinetic energy of the electrons emitted by photocathode 18 provides the energy to sustain oscillations. Since no accelerating voltages are employed, the electron energy is rather low, a few electron volts (eV) or less, and is a function of the difference between the photon energy of the incoming light and a work function that is characteristic of the photocathode material. Accordingly, it is desirable that the photocathode have a work function that is as low as possible. For frequencies greater than a characteristic threshold frequency, the number of electrons emitted by the photocathode is proportional to the intensity of the incident light, but energy per electron is a linear function of frequency and is independent of intensity. Also, the reflector electrode may be provided with a mirrored surface so that the unused photons can be reflected back to the photocathode, causing more electrons to be emitted.

In the half-cycle operating mode, electrons that are emitted from the photocathode make a single pass through the grids and strike the reflector electrode, as shown at 58, or may undergo a single reflection back to the photocathode, as shown at 60. In either event, electrons having a transit time such that they are in phase with the RF field give up energy to the RF field to reinforce the oscillations. With the center tap 50 of inductor 38 grounded (or connected to the photocathode and reflector electrode) the RF field in the reflection region adjacent to reflector electrode 24 (and in the photocathode region adjacent to photocathode 18) is 180° out of phase with the RF field in the region between the grids so that the electrons remain in phase with the RF field in each region and are continuously decelerated as they approach the reflector electrode.

Computer simulations of electron trajectories indicate that self-oscillation in the unbiased mode may involve some bunching of the electrons as they approach the reflector electrode. In addition, it appears that space charge effects in the vicinity of the photocathode may act as a potential barrier to produce spectral shaping of the electron beam beyond the photocathode to create a quasi-monoenergetic beam. Because of the rather low electron energies, i.e., low velocities, the frequencies of operation of Phototron 10 in the unbiased mode are somewhat less than the operating frequencies in the multi-pass, i.e., biased mode. Self-oscillation of Phototron 10 (having the dimensions previously given) in the unbiased mode has been observed in the range of 2–12 MHz. Higher operating frequencies in the unbiased configuration can be achieved by employing smaller interelectrode spacings to decrease the electron cycle time, and by employing higher efficiency photocathodes to increase the kinetic energy of the emitted electrons.

Figure 3:
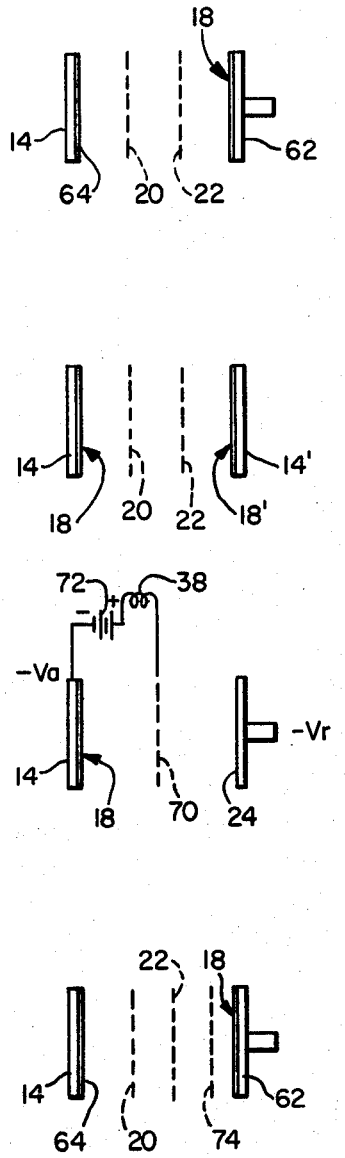
FIGS. 3(*a*)–(*d*) are, respectively, schematic views of other embodiments of the invention.

FIGS. 3(*a*)-(*d*) illustrate diagrammatically other Phototron devices in accordance with the invention. (The dimensions illustrated are not to scale.)

In the embodiment of FIG. 3(*a*), the positions of the photocathode and the reflector electrode are reversed from the positions previously described. As shown, photocathode 18 may be formed on an opaque metallic plate 62 (such as reflector electrode 24 of the embodiment of FIG. 1), and a metallized thin film 64 may be deposited on the inside of window 14 to serve as the reflector electrode. This embodiment is preferable in that it appears to have a somewhat higher photocathode efficiency than the embodiment of FIGS. 1 and 2, which is believed due to the fact that a thicker photoemissive layer may be employed and that the metal-backed photocathode operates cooler. This embodiment may be operated in circuit configurations similar to those illustrated in FIGS. 1 and 2.

In a preferred form, the Phototron of FIG. 3(*a*) may have the same diameter, i.e., 58 mm, as the Phototron of FIGS. 1 and 2, but may employ interelectrode spacings of 10 mm between photocathode 18 and grid 22, 5 mm between grids 20 and 22, and 8 mm between grid 20 and reflector electrode 64. A device having these dimensions has been operated at frequencies as high as 800 MHz using bias voltages of the order of 100 volts.

The embodiment of FIG. 3(*b*) does not employ a reflector electrode per se. Rather, as shown, the reflector electrode may be replaced with another window 14' having deposited on its inside surface another photocathode 18'. In this embodiment, the two photocathodes emit opositely directed electron beams, and each photocathode serves the function of a reflector electrode. In this embodiment, the grids may be biased with respect to the two photocathodes such that the voltages and electric fields are symmetrical about a plane midway between the grids, as by connecting the bias voltages to a center tap of an inductor connected to the grids.

FIG. 3(*c*) illustrates an embodiment that employs a single grid 70. In this embodiment, an accelerating voltage source 72 may be connected between the photocathode 18 and grid 70 in series with inductor 38. Although devices in accordance with this embodiment have some of the desirable features of other embodiments of the invention, in general, they have a lower efficiency and are not preferred forms of the invention.

Figure 4:
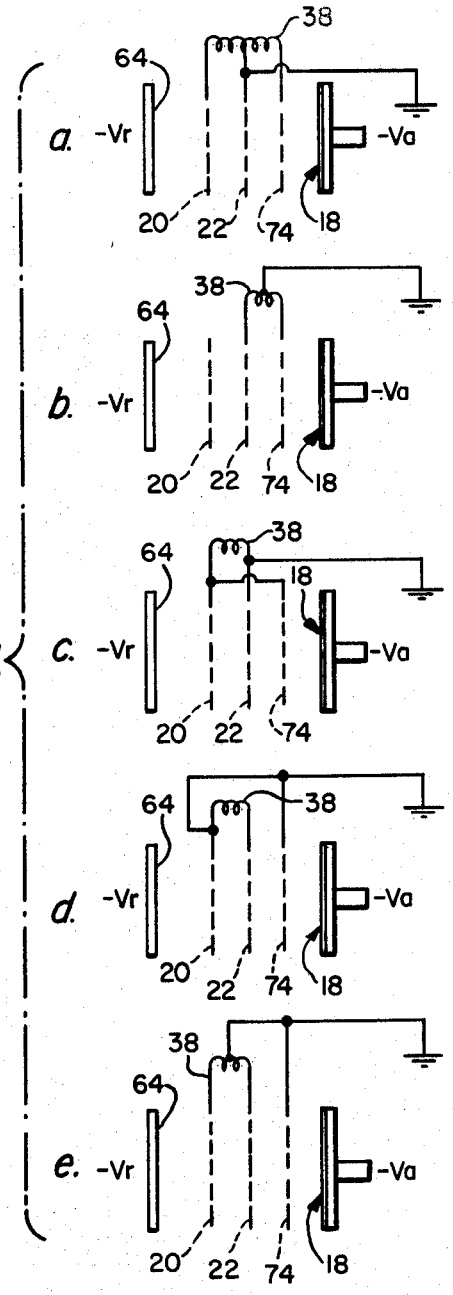
FIGS. 4(*a*)–(*e*) are schematic views illustrating various connection configurations for the embodiment of FIG. 3(*d*)

FIG. 3(*d*) illustrates a three-grid Phototron that is essentially the embodiment of FIG. 3(*a*) with an additional grid 74 placed midway between the photocathode 18 and grid 22. The new grid allows modification of the space charge which develops in the region of the photocathode, and defines an additional region within the device in which the electrons can interact with the RF electric field. The magnitude and phase of the RF field in each region defined by the grids is determined by the connection configuration of the inductor 38 to the grids. FIGS. 4(*a*)-(*e*) illustrate five different connection configurations which may be employed, wherein, one side or a center tap of inductor 38 may be grounded, and negative reflection and acceleration voltages may be applied to the reflector electrode and photocathode, respectively. Initial testing indicates that the three-grid Phototron of FIG. 3(*d*) seems to have a higher efficiency than other types of Phototrons. In addition, using an inductor which produces a resonant frequency of approximately 11 MHz, operating modes which show a more or less continuous variation from 60 to over 200 MHz have been observed.

Figure 5:
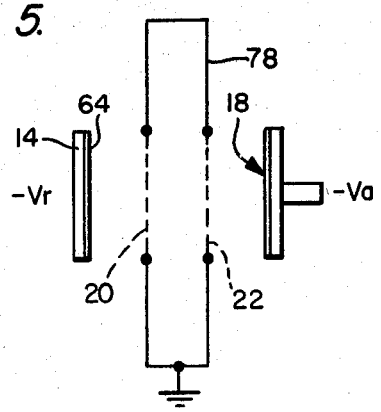
FIG. 5 is a schematic view illustrating the embodiment of FIG. 3(*a*) employed with a resonant cavity.

The embodiments of FIGS. 3(*a*)-(*d*) operate substantially as described in connection with FIGS. 1 and 2. As noted above, Phototron devices in accordance with the invention have been operated at frequencies from 2 to 800 MHz in the biased configuration. Above approximately 100 MHz, inductors become impractical and may be replaced with a resonant cavity 78, as shown schematically in FIG. 5. The resonant cavity may be either external to the Phototron, or may be built into the Phototron as a part thereof. Based on tests of Phototron devices in accordance with the invention, is appears possible to increase the efficiency of the Phototron at higher frequencies by decreasing the grid separation and the spacings between the grids and the photocathode and reflector, and by employing a negative electron affinity photocathode material, such as gallium arsenide. For example, the embodiment of FIG. 1 operates at approximately 200 MHz with bias voltages of the order of 50 volts and a mode number $n=5$. Reducing the interelectrode spacings by a factor of five would enable the Phototron to operate at lower voltages and with a mode number of $n=1$, resulting in a higher efficiency. Furthermore, smaller spacings will reduce losses due to beam spreading.

As noted earlier, higher operating frequencies are associated with higher voltages, and the operating frequency may be varied somewhat by varying the voltages. Oscillation, per se, is not highly sensitive to the interelectrode voltages or dimensions; however, the exact frequency of oscillation is sensitive to these parameters. At an operating frequency of 10 MHz, the Phototron of FIG. 1 has a sensitivity of about 20 microvolts/Hz. Accordingly, the Phototron may be easily modulated by modulating the accelerating or reflector electrode voltages, and may be used as a voltage controlled oscillator. Slight pressure on the glass housing 12 can also cause the output frequency to vary, indicating that the Phototron can be used as a highly sensitive mechanical displacement sensor or as a microphone. The Phototron is also very sensitive to reactance changes in its immediate surroundings, and responds to the presence of a human being several feet away by small changes in its output frequency. Accordingly, it is useful as a wireless intrusion alarm. Since the Phototron is sensitive to the light intensity, it may also be used as a light beam demodulator.

As noted earlier, Phototron devices in accordance with the invention have some similarities to reflex klystrons. However, there are significant differences, both in their structures and in their modes of operation. To begin with, klystrons employ thermionic cathodes, high accelerating voltages, and high energy electrons. Klystrons also employ elongated structures and focused beams so that the beam width is quite small in comparison to its path length, and they depend for their operation upon velocity modulation of the beam to produce electron bunching. This requires field-free drift spaces. The electrons spend a very small portion of their transit time in an RF field and thus transfer energy to the RF field only during a small portion of their cycle.

In contrast, Phototron devices in accordance with the invention employ low voltages and low energy electrons (as low as 0.5 eV in the unbiased mode). The electrons spend nearly all of their cycle time in a varying electric field, even in the reflection regions adjacent to the reflector electrode and to the photocathode. In addition, the electrons undergo multiple oscillations back and forth through the grids (in the multi-pass mode) and remain in phase with the RF field so that they are able to transfer energy to the RF field substantially continuously. Parasitic electrons which are emitted from the photocathode at a phase such as to be accelerated by the RF field are immediately removed from the beam (typically within their first cycle) by collision with either the reflector electrode or the photocathode. This results in electron selection, rather than electron bunching. Furthermore, because of their dimensions, Phototrons do not require beam focusing. The electron beam width is rather large in comparison to the focused electron beam in a klystron, and is preferably greater than the path length between the photocathode and reflector electrode. Also, klystrons will not operate unbiased, as will Phototrons.

Because they operate with low voltages, have low input power requirements, and do not require a modulated light source, Phototrons may be employed for converting solar energy directly into RF energy, making them useful for satellite applications. Furthermore, from the foregoing, it is apparent that the principles of the invention are applicable to different types of electromagnetic energizing radiation other than light, and that the invention may employ charged particles other than electrons, i.e., protons, mesons, ions, or other particles having an electric charge. For operation with other types of electromagnetic radiation, photocathode 18 may be replaced with an appropriate material that is responsive to the electromagnetic radiation for producing charged particles.

While several preferred embodiments of the invention have been shown and described, it will be apparent to those skilled in the art that changes can be made in the embodiments without departing from the principles and spirit of the invention, the scope of which is defined in the appended claims.

I claim:

1. A device for generating RF energy from electromagnetic radiation comprising emitter means responsive to the electromagnetic radiation for producing a beam of charged particles, an electrode spaced from the emitter means, the emitter means and the electrode defining a path therebetween along which the charged particles move, the path having a predetermined path length and the emitter means having a dimension transverse to the path that is greater than the path length such that the beam of charged particles has a transverse dimension greater than the path length, and a resonant structure for supporting RF oscillations, the resonant structure being located with respect to the path so as to define a plurality of RF field regions along the path and so as to enable continuous energy transfer in each region from the charged particles to an RF field associated with the RF oscillations, the resonant structure comprising a pair of grids spaced along said path and with both grids having a positive bias relative to said emitter means and said electrode.

2. The device of claim 1, wherein the path is positioned such that it is substantially totally within the RF field regions so as to enable energy transfer to the RF field over substantially the entire path.

3. The device of claim 1, wherein the ratio of the surface area of the emitter means to the path length is at least 2:1.

4. The device of claim 1, wherein the beam of charged particles comprises low energy charged particles.

5. The device of claim 4, wherein the energy of the charged particles is less than about 100 eV.

6. The device of claim 5, wherein the energy of the charged particles is of the order of a few eV.

7. The device of claim 1, wherein the bias sets the transit time of the charged particles along the path such that selected charged particles transfer energy to the RF field to reinforce the RF oscillations and such that charged particles that do not have proper phase relationship to the RF field to transfer energy thereto are eliminated from the beam.

8. The device of claim 7, wherein the bias is set to cause the selected charged particles to make successive passes along the path while remaining substantially in phase with the RF field to transfer energy thereto.

9. The device of claim 8, wherein the electrode is a reflector electrode for reflecting the charged particles.

10. The device of claim 9, wherein the bias is less than about 100 volts.

11. The device of claim 9, wherein the bias sets the transit time of the charged particles along the path such that the transit time is an integral or near integral multiple of the period of the RF oscillations.

12. The device of claim 9, wherein the grids are grounded and the emitter means and the electrode are biased negative with respect to ground potential.

13. The device of claim 9, including a further grid.

14. The device of claim 9, wherein the resonant structure includes an inductor connected to the pair of grids.

15. A device for generating RF energy from electromagnetic radiation comprising emitter means responsive to the electromagnetic radiation for producing a beam of charged particles, an electrode spaced from the emitter means, the emitter means and the electrode defining a path therebetween along which the charged particles move, and a resonant structure for supporting RF oscillations disposed between the emitter means and the electrode and positioned with respect to the path so as to enable continuous energy transfer from the charged particles to an RF field associated with the RF oscillations over a large portion of the path, the resonant structure comprising a pair of grids spaced along said path and with both grids having a positive bias relative to said emitter means and said electrode, and wherein the device is free of beam focusing structure such that the beam of charged particles moving along the path is unfocused, the dimensions of the emitter means being such as to provide a beam having a substantial cross-sectional dimension and the spacing between the electrode and the emitter means being such as to minimize beam spreading.

16. The device of claim 15, wherein the spacing between the emitter means and the electrode is set such that the charged particles are within the RF field for substantially their entire transit time between the emitter means and the electrode.

17. The device of claim 15, wherein the emitter means, the resonant structure, and the electrode define successive regions along the path and are interconnected such that the charged particles transfer energy to the RF field in each of said regions.

18. The device of claim 15, wherein the bias is set to cause charged particles to make multiple passes along the path while remaining substantially in phase with the RF field to continuously transfer energy thereto.

19. The device of claim 18, wherein the bias is set such that the cycle time required for the charged particles to move along the path from the emitter means to the electrode and back to the emitter means is an integral or near integral multiple of the period of the RF oscillations.

20. The device of claim 15, wherein the bias sets the transit time of the charged particles along the path such that selected charged particles transfer energy to the RF field to reinforce the RF oscillations and such that charged particles that do not have a proper phase relationship to the RF field to transfer energy thereto are eliminated from the beam.

21. The device of claim 15, wherein the beam of charged particles moving along said path comprises low energy charged particles.

22. A device for generating RF energy from electromagnetic radiation comprising emitter means responsive to the electromagnetic radiation impinging upon the emitter means for producing a beam of charged particles, an electrode spaced from the emitter means, the emitter means and the electrode defining a path therebetween along which the charged particles move, the charged particles moving along said path primarily as a result of the kinetic energy imparted to the charged particles by the electromagnetic radiation that produces the charged particles, and a resonant structure disposed between the emitter means and the electrode for supporting RF oscillations, the resonant structure being located with respect to the beam of charged particles to enable energy transfer from charged particles to an RF field associated with the RF oscillations, said device being free of externally applied voltages.

23. The device of claim 22, wherein the charged particles have low energies of the order of a few electron volts.

24. The device of claim 22, wherein a passive electrical element is connected between the electrode and the resonant structure to provide a current path that biases the electrode with respect to the resonant structure.

25. The device of claim 22, wherein the dimensions of said device are such that the charged particles that transfer energy to said RF field are in phase with said field.

26. The device of claim 22, wherein the cross-dimensions of said beam are substantially greater than the length of said path.

27. The device of claim 22, wherein said resonant structure comprises a pair of grids spaced along said path and interconnected by an inductance.

28. The device of claim 27, wherein said inductance has a tap connected to said electrode by a resistance.

29. A device for generating RF energy from electromagnetic radiation comprising emitter means responsive to the electromagnetic radiation for producing a beam of low energy charged particles, a reflector electrode spaced from the emitter means, the emitter means and the electrode defining a path therebetween along which the charged particles move, a resonant structure for supporting RF oscillations disposed between the emitter means and the electrode and positioned with respect to the path to enable energy transfer between charged particles and an RF field associated with the RF oscillations, the resonant structure comprising a pair of grids spaced along said path and with both grids having a positive bias relative to said emitter means and said electrode, said bias being set to cause charged particles to remain substantially in phase with the RF field as they move along the path to continually transfer energy thereto.

30. The device of claim 29, wherein the bias is set to cause the charged particles to make multiple passes along the path while remaining continuously substantially in phase with the RF field.

31. The device of claim 30, wherein the charged particles have energies in the range of a few electron volts to approximately 100 electron volts, and the low voltage means is about 100 volts or less.

32. The device of claim 29 the transit time of the charged particles along the path such that selected charged particles transfer energy to the RF field to reinforce the RF oscillations and such that charged particles that do not have a proper phase relationship to the field to transfer energy thereto are eliminated from the beam.

33. The device of claim 29, wherein the path of the charged particles is substantially totally within the RF field, and the beam of charged particles is unfocused.

34. The device of claim 1, 17, 25 or 29, wherein the electromagnetic radiation comprises light, the emitter means comprises a photocathode, and the charged particles comprise electrons.

35. The device of claim 34 further comprising a housing for enclosing the photocathode, and wherein the photocathode comprises a layer of photoemissive material deposited on the inside surface of a window of the housing through which the light passes.

36. The device of claim 34 further comprising a housing for enclosing the photocathode, and the electrode, and wherein the photocathode comprises a layer of photoemissive material deposited on a metallic member within the housing, and the electrode comprises a thin metallic layer deposited on the inside surface of a window of the housing through which the light passes.

37. The device of claim 34, wherein the resonant structure comprises a resonant cavity.

38. A method of generating RF energy from electromagnetic radiation comprising producing from the electromagnetic radiation an unfocused beam of low energy charged particles that move along a predetermined path, locating the path in an RF field associated with RF oscillations in a resonant structure, the resonant structure comprising a pair of grids spaced along said path and with both grids having a positive bias relative to said emitter means and said electrode, and such that the path is substantially entirely without the RF field to enable continuous energy transfer to the RF field from the charged particles as they move along the path.

39. The method of claim 38 further comprising setting the bias such that charged particles that do not have a proper phase relationship with respect to the RF field to transfer energy thereto are eliminated from the beam.

40. The method of claim 38 further comprising setting the bias to cause charged particles to make multiple passes along the path while remaining substantially in phase with the RF field to continually transfer energy thereto.

41. The method of claim 38 further comprising setting the bias such that the transit time of the charged particles along the path is an integral or near integral multiple of the period of the RF oscillations.

42. The device of claim 17, wherein the RF field in each region is in anti-phase with the RF field in a neighboring region.

* * * * *